US005622230A

United States Patent [19]

Giardino et al.

[11] Patent Number: 5,622,230

[45] Date of Patent: Apr. 22, 1997

[54] ROTARY IMPACT WRENCH CLUTCH IMPROVEMENT

[75] Inventors: David A. Giardino, Utica; Peder P. Messina, III, Rome, both of N.Y.

[73] Assignee: Chicago Pneumatic Tool Company, Utice, N.Y.

[21] Appl. No.: 490,920

[22] Filed: Jun. 15, 1995

[51] Int. Cl.[6] ..... B25D 15/00

[52] U.S. Cl. ..... 173/93.5; 173/93

[58] Field of Search ..... 173/93, 93.5, 93.6, 173/93.7

[56] References Cited

U.S. PATENT DOCUMENTS

| | | | |
|---|---|---|---|
| 2,463,656 | 3/1949 | Thomas | 173/93.5 |
| 2,850,128 | 9/1958 | Van Sittert | 173/93.5 |
| 3,174,597 | 3/1965 | Schaedler et al. | 192/30.5 |
| 3,228,486 | 1/1966 | Kaman et al. | 173/93.6 |
| 3,533,479 | 10/1970 | Madsen et al. | 173/93.5 |
| 3,552,499 | 1/1971 | Maurer | 173/93.5 |
| 3,596,525 | 8/1971 | Niesz et al. | 173/DIG. 1 X |
| 4,098,354 | 7/1978 | Alcenius | 173/93.5 |
| 4,347,902 | 9/1982 | Wallace et al. | 173/93.5 |
| 4,533,337 | 8/1985 | Schoeps | 173/93 |
| 4,585,078 | 4/1986 | Alexandrov et al. | 173/93.5 |

*Primary Examiner*—Scott A. Smith

*Attorney, Agent, or Firm*—Schmeiser, Olsen & Watts

[57] ABSTRACT

An economically and technologically improved assembly for developing kinetic energy in a rotary impact tool. There is disclosed herein a two-part, readily assembled and disassembled pin cage-coupler. One part, a cylindrical, longitudinally grooved cage, which contains a clutch mechanism, is capped at one end by a lobed end plate coupler. Since there is no physical bonding during the functional life of these parts, they may be made separately by various metal working technologies, including sintering and forging.

12 Claims, 3 Drawing Sheets

ROTARY IMPACT WRENCH CLUTCH IMPROVEMENT

BACKGROUND OF THE INVENTION

I. Field of the Invention

This invention relates to an improved assembly for developing kinetic energy in a rotary impact tool. Specifically, there is disclosed herein a two-part, readily assembled and disassembled pin cage-coupler which, until now, is mechanized as a unitary device. This two-piece realization lends itself not only to more economical fabrication and repair, but to more cost-effective production as well.

II. Discussion of the Relevant Art

There are presently rotary impact tools of great variety. One such tool employing a cage hammer uses two roller elements to transmit, impulsively, kinetic energy of the motor driven cage hammer to the anvil. This concept is disclosed in U.S. Pat. No. 3,174,597 and in a later diverse application, in U.S. Pat. No. 4,347,902, both of which deal with rotary tool clutch mechanisms. Current art utilizes a unitary cage hammer that contains the coupling means whereby angular force is taken off the motor output shaft. It is such current art that is improved by the instant invention in order to avoid limitations on production and repair that devolve from the unitary construction of cage hammer and coupling means. Further, the cost of production inherent in the unitary construction (further delineated hereinafter) has clearly militated the invention.

Separate production, or functional separation, of a coupler from a cage or inertial mass is not unknown in the art. In U.S. Pat. No. 2,463,656, there is disclosed a diametrically lobed disc, containing a centrally disposed spline receiver, and which is employed to fittingly engage knotches at one end of a bifurcated cylinder that serves as a hammer for a rotary impact tool. Because of designed movement between the halves of the split cylinder, the disc does not effectively plug the cylinder end and is only fitted loosely therein. Correspondingly, the cylindrical hammer effects an elliptically shaped inner surface that is completely unrelieved and not adapted for receiving rollers of the previously described and instant implements. Thus, neither the '656 hammer nor disc (coupling means) would prove suitable for use in the instant invention. Similar in appearance to this invention is the disclosure of U.S. Pat. No. 4,585,078 wherein a circular coupling disc is mated to an end of a cylindrically shaped hammer by means, of eccentrically disposed disc projections, that protrude in an axial direction, for engagement with chordwise disposed grooves at one end of the cylindrical hammer. The disc element of '078, called an intermediate member, rotates about a common axis of the tool while the eccentric projections, loosely engaging the chordwise grooves, cause the hammer member to rotatingly translate in a plane perpendicular to the axis of rotation. Such translational action is inconsistent with, and to be avoided by, those who would practice the instant invention.

Absent in the relevant art is any mention of deleterious effects of a radial translation by pins or rollers on the symmetry of a toroidal or annular cage. It has been observed that a deformation, oblate misshaping, may occur under certain operating conditions. To ameliorate this defect, a second embodiment, an adjunct mechanism is provided to the invention.

III. Incorporation by Reference

Patents disclosing elements of the present invention or rotary impact wrench clutch mechanisms, as improved hereby, namely, U.S. Pat. No. 's 2,463,656, 3,174,597, 4,347,902, and 4,585,078 are hereinafter incorporated by reference.

SUMMARY OF THE INVENTION

Presently, two methods are employed for the production of the aforementioned unitary cage hammer containing coupling means. The earlier of the two consists in machining a longitudinally grooved cylinder out of bar stock. In addition to simply boring the bar stock, a one piece cutting operation, several machining steps had to be accomplished in order to provide groove seats for rollers within the inner surface of the cylinder, centrally disposed spline engaging means so that one end of the cylinder, remaining closed, could be adapted for engagement with the motor output shaft, and several other internal machining operations to provide the geometry at the closed end of the cylinder which was necessary to accommodate the remaining clutch mechanism, as well as to provide journaling means for the tool anvil. A second method is analogous to placing a lid on a cylindrical can. It requires production of the cylinder from bar stock, but the first cutting operation entails boring completely through to provide a open-ended cylinder. A disc is then machined from the same bar stock and provided all of the relief and spline receiving means as in the aforesaid unitary piece. The disc, analogous to the can cover, is then press fitted to an open end of the cylinder and butt welded thereto. Extreme care must be taken that the spline receiving means is perfectly coaxial with the cylindrical axis of rotation. Further, additional machining is required because the weld bead must be reduced.

Both of the above processes are obviated by the instant invention. Advancing the art of the previous methods, a cylinder and a disc (hereinafter "coupler") are prepared with the same relief and definition except that the disc is now provided a plug feature consisting in a shoulder periphery, that is diminished to a concentric trunk feature. This trunk feature is diametrically lobed, so that the lobes thereof act as keys to be fitted into the roller, i.e., "pin" grooves of the cylinder (hereinafter "cage"). The lobe or key fit is tight, or close fitting, and obviates the need for welding. The shoulder of each lobe is the circumferential perimeter of the trunk portion of the disc, which is also tight fitting with the inner surface of the cage. The motor drive and coupling are true, so that the cage revolves perfectly about the tool major axis of rotation.

Lastly, a previously mentioned adjunct is provided that prevents oblate deformation which could occur in the toridal or annular shape of the cage. At the forward open end, a circumferential lip, essentially orthogonal to the cylinder and extending radially inward, is formed integrally with the cylinder. The inner periphery of the lip defines a centrally-disposed hole which is chamfered internal of the cylinder so as to provide a seat for a collar portion of the anvil. Thus, the adjunct serves as both a deformation constraint and a journal bushing.

No longer requiring a welding process, the instant device readily lends itself to more advanced fabrication technology such as sintered metal production. Avoidance of welding, and the extensive machining of past practices, has gleaned significant economical benefit; and, termination of the unitary construction of cage-coupler has resulted in better quality control, faster assembly and easier repair (disassembly) of the subject tool.

Further, lobes as conceived herein are superior to axially projecting lugs because: (1) they are not as susceptible to shear forces; and (2) their number may be readily increased in diametrically opposed pairs or single lobes without disturbing the rotational balance.

DETAILED DESCRIPTION OF THE PREFERRED EMBODIMENT

Relative to the description in the appended claims given hereinafter, "radiused" shall mean having a circular definition; and "shoulder" shall mean a flange-like feature that defines "trunk", which is the base feature from which a shoulder projects. "Lobe" shall mean a projection from a surface that is essentially coplanar to that surface; and "clutch pins" or "pins" shall be synonymous with "rollers" of the prior art.

Figure 1:
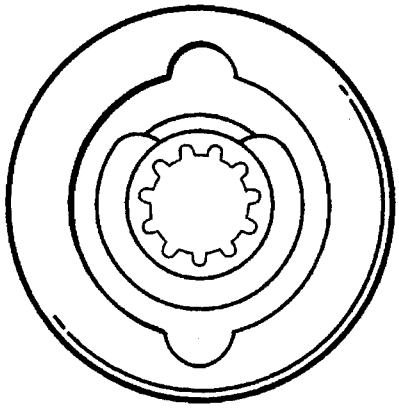
FIG. 1 PRIOR ART
FIGS. 1 and 2 are orthographic illustrations of prior art.
Figure 2:
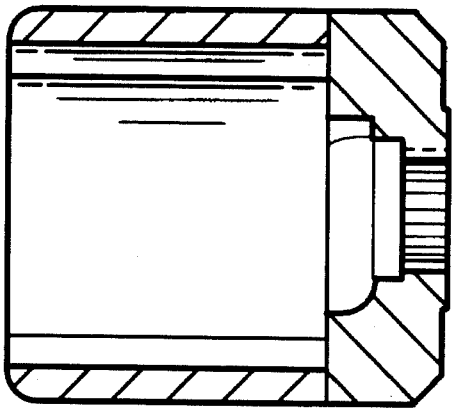
FIG. 2 PRIOR ART

Referring to FIGS. 1 and 2, there is shown in orthographic illustration, an end view and a cross sectional side elevation, respectively, of a unitary cage-coupler of the prior art.

Figure 3:
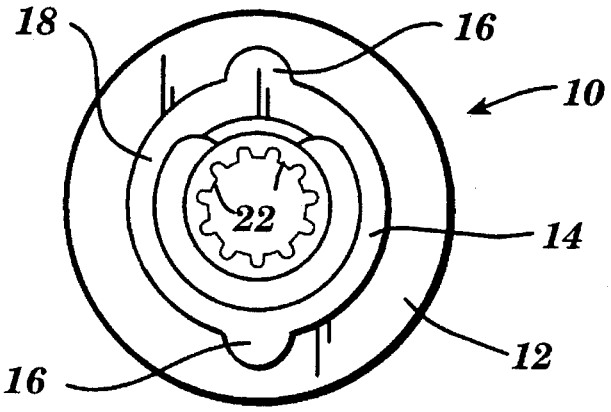
FIG. 3 is an elevational view of the insertable coupler end.
Figure 4:
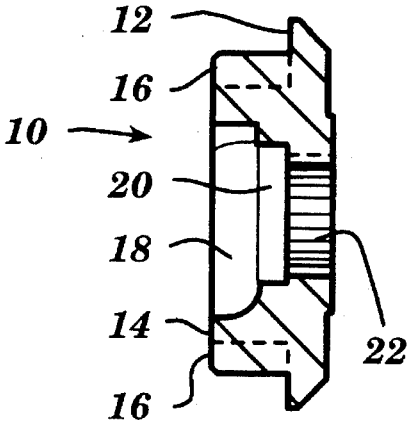
FIG. 4 is cross sectional side elevation of the FIG. 3 coupler.

FIGS. 3 and 4, are orthographic illustrations of the plug-like end plate 10 of the instant invention. A cap portion or shoulder 12 establishes the circumferential definition of the end plate. This shoulder further defines a trunk 14 that is concentric with the shoulder but is distinguished by the diametrically disposed lobes 16 that project coplanar from the trunk 14. The trunk is alternately described as a smaller disc that is lobed and concentric with the shoulder portion. Alternately, the shoulder portion may be described as a circular flange. Concentric with both shoulder and trunk are three progressively smaller apertures 18, 20, 22, respectively.

Figure 7:
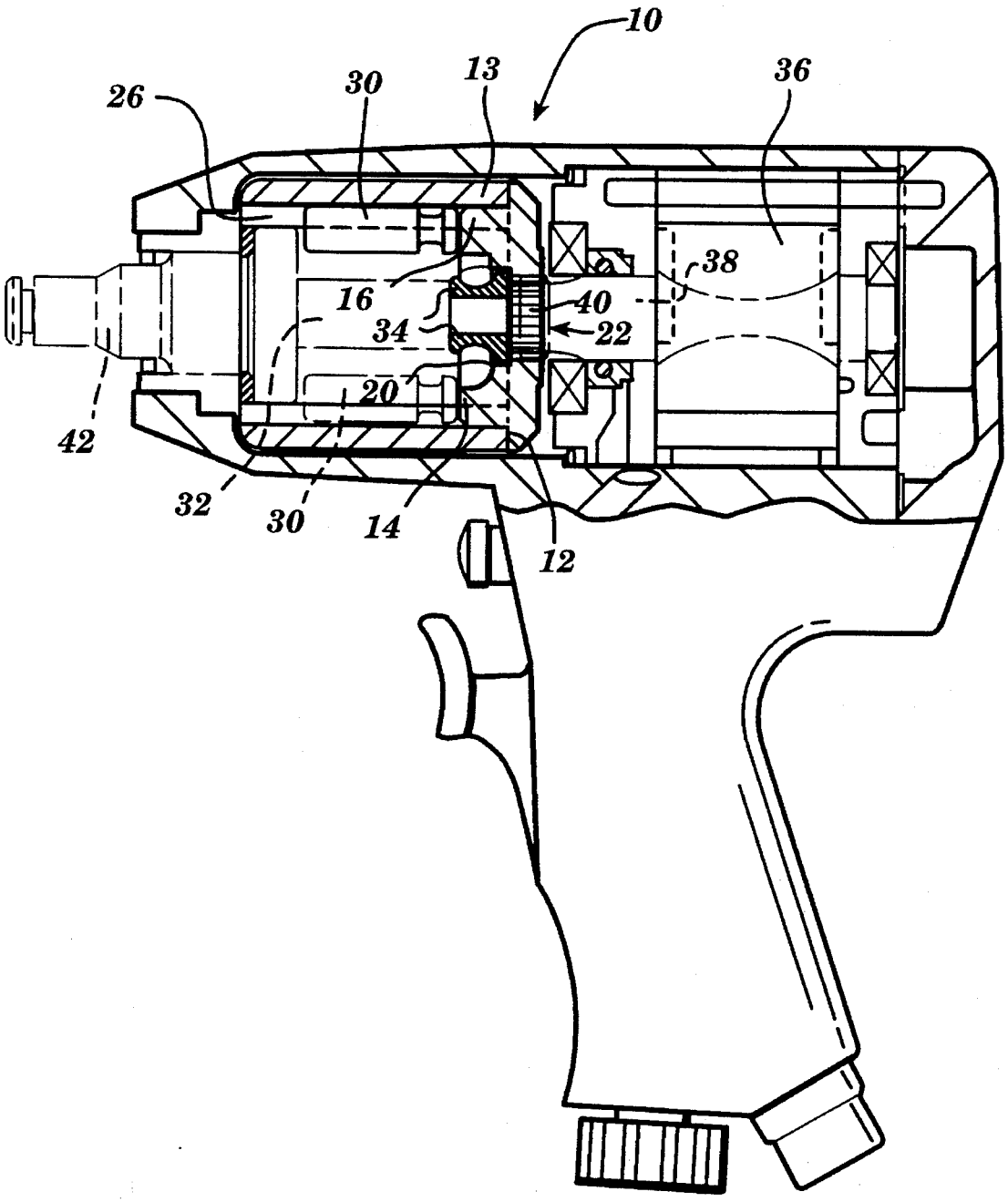
FIG. 7 is a partial sectionalized side view of a rotary tool containing the invention.

The largest of these is, in assembly, closest to the cage and provides a rear end bore to admit the anvil A assembly (see FIG. 7). The smallest provides a spline receiver 22, here a toothed, inside gear.

Figure 5:
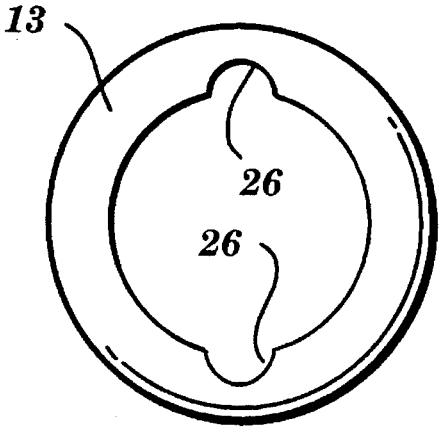
FIG. 5 is an elevational end view of the cage.
Figure 6:
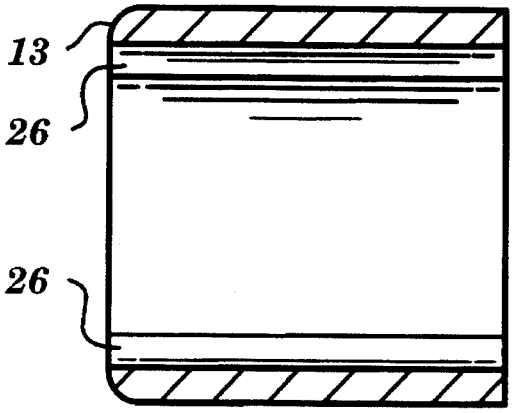
FIG. 6 is a cross sectional side elevation of the FIG. 5 cage.

The cage 13 end view and sectional side elevation are depicted in FIGS. 5, and 6, respectively. Therein, the longitudinal grooves 26 which fulfill a dual function, retainment of the clutch pins 30 (See FIG. 7) and capture of the lobes 16, are depicted in arcuate relief, being radiused precisely to fulfill this dual function.

Next in the drawings, FIG. 7 illustrates, in a partly sectionalized side elevation, placement of the invention in a rotary impact tool of the type presently utilizing the unitary construction of FIGS. 1, and 2. Physical accomodations have been made so as to allow the clutch pin 30 to take up the proper functional residence disposed between the cage 13 and the anvil 32. Axially disposed cam pilot 34 is journaled in end plate 10 at journal bearing 20. Similarly, the motor 36 output shaft 38 is spline 40 coupled with the end plate 10 at spline receiver 22.

Those familiar with this art may readily see how the FIG. 7 tool, which is easily assembled beginning with insertion (into the case) of the output drive shaft 42, installation of the anvil cage members, insertion of the clutch pin mechanism, and closure with the end plate, may be simply disassembled. The ease of assembly and disassembly is further enhanced by the production processes described in the SUMMARY OF THE INVENTION.

Figure 8:
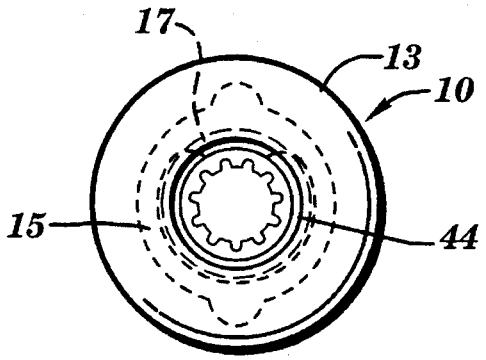
FIG. 8 is an elevational view of the forward open end of the cage.
Figure 9:
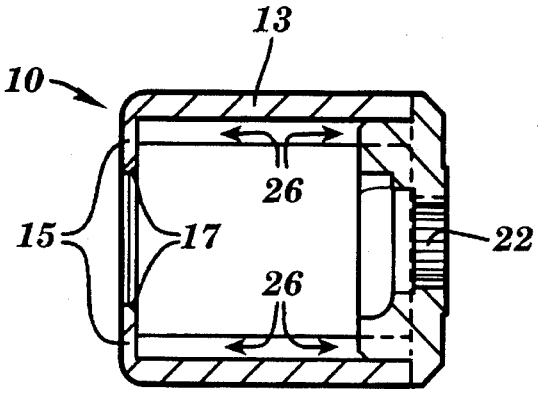
FIG. 9 is a cross sectional side elevation of the FIG. 8 cage.

Having detailed our preferred embodiment, we turn to the previously mentioned adjunct which is employed to prevent the aforesaid oblate deformation of the cage 13. Referring particularly to FIGS. 8 and 9, the reader will note that the forward end of the cage 13 is flanged radially inward to define a lip 15 and centrally disposed hole 44. The hole 44 is formed to define a chamfered surface 17, the purpose of which is disclosed in the discussion of FIG. 10.

Figure 10:
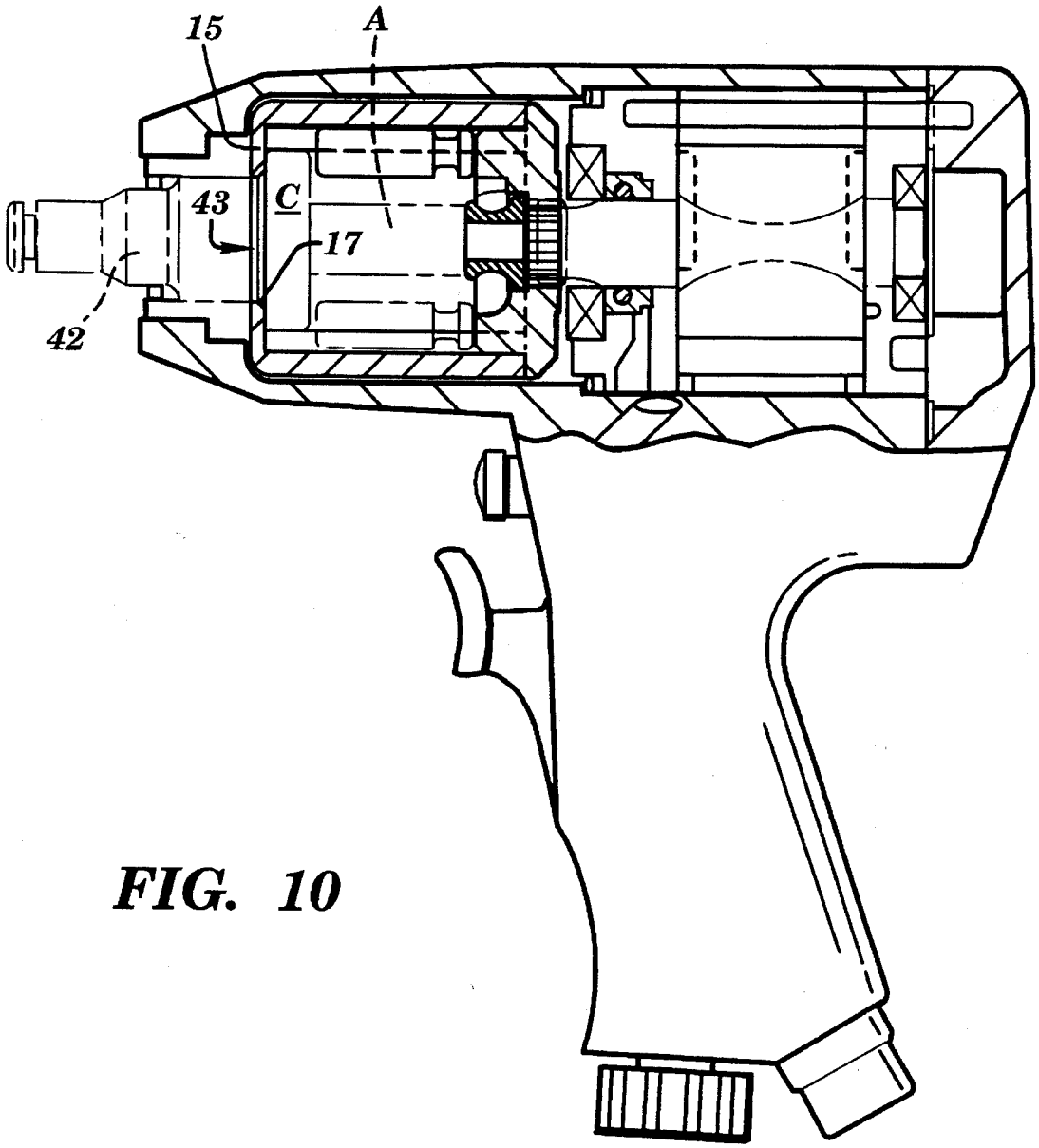
FIG. 10 is a partial sectionalized side view of a rotary tool containing an alternate construct of the invention.

FIG. 10 is practically identical with FIG. 7 relative to the invention (proper). In this alternate embodiment, the chamfered surface 17 of cage 13 provides a seat for a portion of the anvil A. A collar C of the anvil is subtended (in the tool's forward direction) by a beveled bearing surface 43 that, in assemblage, is seated at the hole 44, being journaled in and on chamfered surface 17. Thus, the lip prevents deformation in the annularity of the cage 13, while the additional bearing mechanism 17/43 of the cage/anvil combination decreases wear on the overall anvil bearing and bushing assembly (prior art).

The invention comprises an advancement in rotary impact tools of this type and is commended to the field consistent with the hereinafter appended claims.

What is claimed is:

1. A rotary impact tool cage means for urging a cylindrical pin roller into engagement with an anvil which is disposed internally of said cage means, and comprising a hollow cylindrical member having at least one internal lognitutidnal groove, a first open end and a second open end, said cylindrical member including a spline-drivable, removably and press-fittable cap and the second open end, said cap featuring at least one eccentric element that is seatable within said at least onto internal longitudinal groove.

2. The cage means of claim 1 wherein said first open end includes a circumferential lip that defines said first open end as a chamfered hole.

3. The cage means of claim 2 wherein the chamfered hole is a seat means for the anvil.

4. A rotary impact tool cage means for urging a cylindrical pin roller mechanism into engagement with an anvil, which is disposed internally of said cage means, and comprising a hollow cylindrical member featuring at least one internal, lognitudinal groove and having a first open end and a second open end, said cylindrical member featuring a circumferential lip on said first open end and a spline-drivable, removably and press-fittable cap at the second open end, said cap featuring at least one eccentric element that is seatable within said at least one internal lognitudinal groove.

5. The cage means of claim 4 wherein said at least one internal lognitudinal groove is receptive therein of at least one said cylindrical pin roller mechanism.

6. The cage means of claim 5 wherein said lip includes chamfered means for bearing engagement with a portion of said anvil.

7. The cage means of claim 6 further comprising a second diametrically opposed groove in said cylindrical member and a second diametrically opposed eccentric element included in said cap.

8. A rotary impact tool pin cage-coupler combination that is readily assembled and disassembled comprising:

a coupler disc having therein concentric spline receiving means and, on a face thereof, an integral and smaller lobed disc concentric with the coupler disc, the coupler disc removably fittable to a cage member and defining at least one radiused lobe; and a cage member defining an open ended cylinder having on an inner surface at least one longitudinal, arcuate groove of a radius identical with that of said at least one lobe and with that of a clutch pin that is used in said tool, said arcuate groove removably receptive of said at least one lobe at a first end of said member.

9. The combination of claim 8 wherein said cage member includes at a second end thereof a radially inwardly disposed flange that defines a hole concentric with said member.

10. The combination of claim 9 wherein said cage member includes, on said inner surface thereof, at least one groove to disengagably embrace said smaller lobed disc at said first end.

11. The combination of claim 8 wherein said spline receiving means further comprises a geared aperture receivable therein of a male spline.

12. The combination of claim 8 wherein said cage member is a cylindrical mass for developing kinetic energy transferred thereto through said coupler disc and in which said inner surface thereof is a cylindrical surface which with said at least one arcuate groove disengagably embraces said smaller lobed disc of the coupler disc at said first end.

* * * * *